US007056055B1

(12) United States Patent
Kuo

(10) Patent No.: US 7,056,055 B1
(45) Date of Patent: Jun. 6, 2006

(54) TRAFFIC CONE (2)

(76) Inventor: Wen-Nan Kuo, No. 144-1 Shangliao Rd., Taliao Town, Kaohsiung County (TW)

( * ) Notice: Subject to any disclaimer, the term of this patent is extended or adjusted under 35 U.S.C. 154(b) by 0 days.

(21) Appl. No.: 11/198,555

(22) Filed: Aug. 4, 2005

(51) Int. Cl.
*E01F 9/012* (2006.01)

(52) U.S. Cl. ..... 404/9; 116/63 C

(58) Field of Classification Search ..... 404/6, 404/9; 116/63 C
See application file for complete search history.

(56) References Cited

U.S. PATENT DOCUMENTS

| | | | | |
|---|---|---|---|---|
| 3,732,842 | A * | 5/1973 | Vara, Sr. | 116/63 P |
| 3,809,007 | A * | 5/1974 | Brown | 116/63 P |
| 4,889,067 | A * | 12/1989 | Provence, Jr. | 116/63 C |
| 4,979,461 | A * | 12/1990 | Provence, Jr. | 116/63 C |
| 5,199,813 | A * | 4/1993 | Nagler | 404/9 |
| 5,421,668 | A | 6/1995 | Cowan et al. | 404/6 |
| 5,722,788 | A | 3/1998 | Bent et al. | 404/6 |
| 5,908,262 | A | 6/1999 | Ahn | 404/9 |
| 6,014,941 | A | 1/2000 | Bent et al. | 116/63 R |
| 6,053,658 | A * | 4/2000 | Gibson, Jr. | 404/10 |
| 6,536,369 | B1 | 3/2003 | Bent et al. | 116/63 P |
| 6,929,419 | B1 * | 8/2005 | Kuo | 404/6 |

FOREIGN PATENT DOCUMENTS

| | | |
|---|---|---|
| CN | 2004-10088911.0 | 10/2004 |
| TW | 94109612 | 10/2004 |

* cited by examiner

*Primary Examiner*—Gary S. Hartmann

(57) ABSTRACT

A traffic cone includes a cone-shaped body and a base. The cone-shaped body has a hole in the top and a connecting circumference formed in a lower end. The connecting circumference is provided with a large number of upright bars spaced apart equidistantly, and a through hole formed between every two neighboring bars. The base is formed in a mold that an already formed cone-shaped body is placed in advance before the base is formed so the base may be combined integral with the cone-shaped body after the base is finished. Then the base completely wraps around and hides the connecting circumference of the cone-shape body, with the through holes of the connecting circumference filled up totally by the base.

2 Claims, 8 Drawing Sheets

TRAFFIC CONE (2)

BACKGROUND OF THE INVENTION

1. Field of the Invention

This invention relates to a traffic cone, particularly to one consisting of a cone-shaped body and a base separately formed to have different colors and then assembled together, taking the advantage of a U.S. patent application Ser. No. 10/917,100 and simplifying the advantages for practicality. When the traffic cone is hit or run over by a vehicle accidentally, the base can be automatically separated from the cone-shaped body, preventing the traffic cone from getting stuck with the chassis of the vehicle so as to safeguard traffic safety.

2. Description of the Prior Art

A conventional traffic cone or traffic delineator disclosed in a U.S. patent Ser. No. 6,014,941 is composed of a cylinder and a base, and the base has a hole for the cylinder to pass through so as to let the traffic cone stand on the ground, with a handle fixed on the top of the cylinder for holding to carry the traffic delineator around. Further, the handle is provided with a hole for a light for warning or the like to insert therein, and the cone-shaped body has an outer smooth surface for sticking a reflective sheeting and a channel to be used as a grip for transporting the traffic cone, and an used as a grip for transporting the traffic cone, and an extending flange formed in its lower end for the base to press to combine stably with the base.

Another conventional traffic cone disclosed in a U.S. patent Ser. No. 5,722,788 includes a barrel and a base. The barrel has a lip formed in a lower portion and the base has an overhand for the lip to fit stably in for assembling the barrel with the base.

Another conventional traffic cone disclosed in a U.S. patent Ser. No. 6,536,369 B1 includes a cylinder and a base. The base is provided with a hole for the cylinder to pass through for assembling so as to let the traffic cone to stand on the ground. The cylinder further has a T-shaped handle for carrying, and the handle has a hole for inserting a light for warning or the like.

Another conventional traffic cone disclosed in a U.S. patent Ser. No. 5,908,262 includes a cylindrical post and a supplemental support panel combined together. The supplemental support panel is provided with a hole for the cylindrical post to pass through for combining so as to stand stably on the ground.

Lastly, one more conventional traffic cone disclosed in a U.S. patent of Ser. No. 5,421,668 includes a cylinder and a weight made of a recycled tire and provided with a hole for the cylinder to pass through so as to let the traffic cone to stand stably on the ground.

The conventional traffic cones described above are all composed of a cone body and a base separately made and then assembled together, having a common drawback that the base and the cone body may often become separated during the process of transportation. And another disadvantage of them is impossibility of stacking one by one so that a large number of them may occupy a large space in storing or transporting. Aside from the above mentioned conventional traffic cones, there are other conventional traffic cones disclosed by the same inventor of this application, in a U.S. patent application Ser. No. 10/917,100, a Taiwan patent application of No. 94109612, and a PRC patent application of NO. 200410088911.0, and they are all composed of a cone-shaped body and a base formed separately and with different colors.

SUMMARY OF THE INVENTION

This inventin has been devised to offer a traffic cone having a cone-shaped body and a base of different colors, and the base is made of recyclable plastic with a deep color, separable from the cone-shaped body in case of collision with some external force to keep safety for traffic. The traffic cone according to the invention has the following advantages.

1. Its cone-shaped body is formed in advance, having a thicker wall for some portion so large number of the traffic cones can be stacked one by one to save the space needed in storing them.

2. Its cone-shaped body has a connecting circumference provided with many upright bars spaced apart equidistantly and a through hole between every two neighboring bars.

3. After the cone-shaped body is formed, it is placed in a mold for forming the base, so after the base is formed by injecting means, the base can wrap around the connecting circumference of the cone-shaped body to form the complete traffic cone in the invention.

4. The base is very heavy to have its gravity center located therein, letting the traffic cone stand on the ground stably enough, not so easily falling down.

BRIEF DESCRIPTION OF DRAWINGS

This invention will be better understood by referring to the accompanying drawings, wherein.

DETAILED DESRIPTION OF THE PREFERRED EMBODIMENT

A first embodiment of a traffic cone in the present invention, as shown in FIGS. 1 to 6, includes a cone-shaped body 1 and a base 2 as main compoments combined together.

Figure 1:
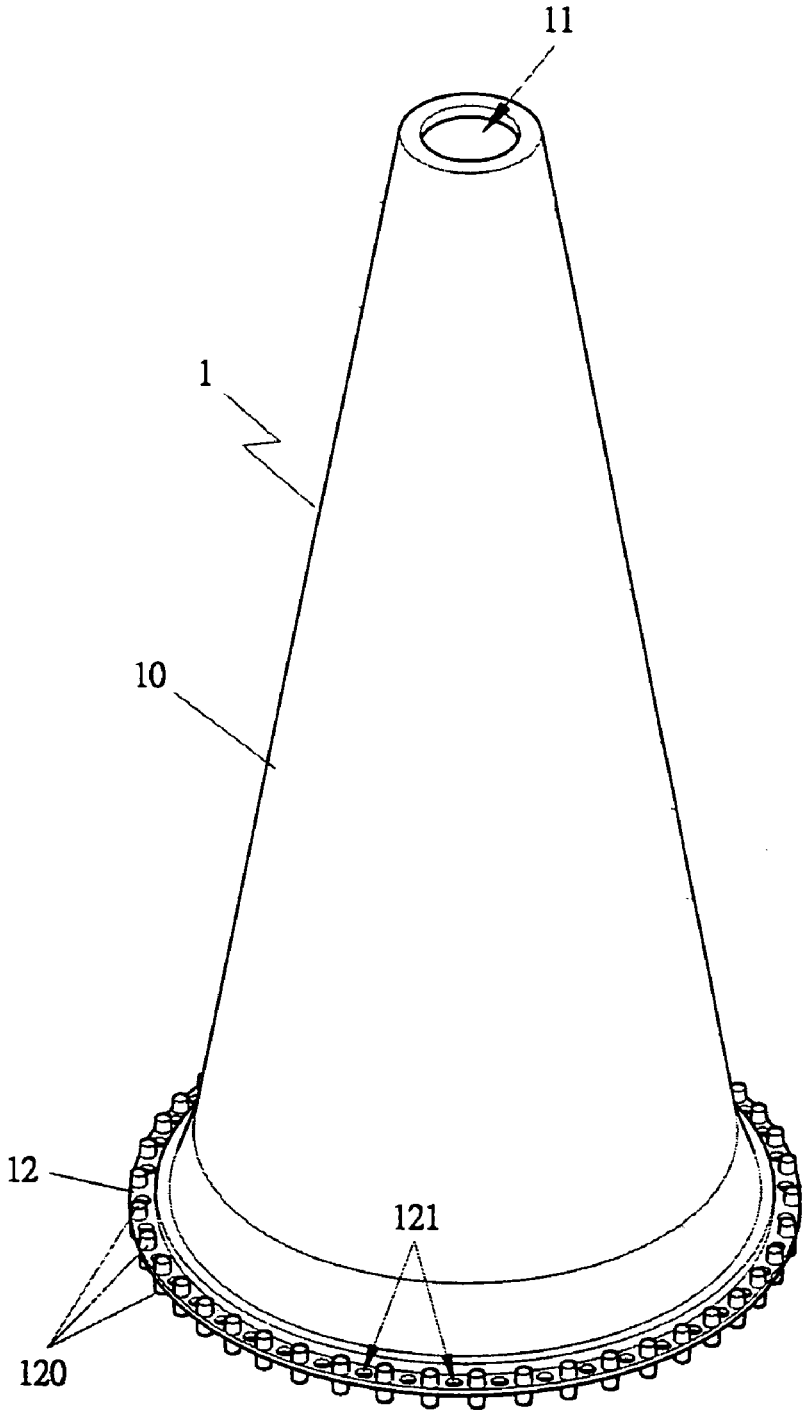
FIG. 1 is a perspective view of a cone-shaped body of a first embodiment of a traffic cone in the present invention.
Figure 3:
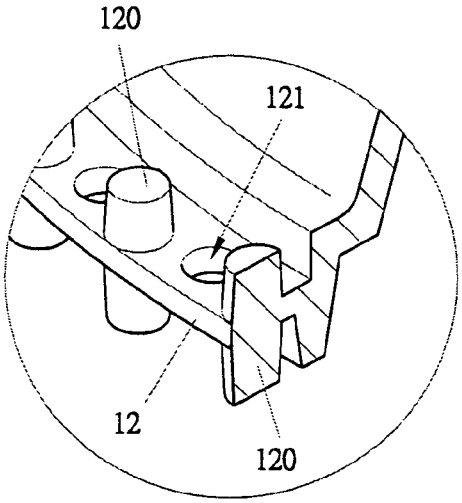
FIG. 3 is a magnified perspective view of a part marked (A) in FIG. 2.
Figure 2:
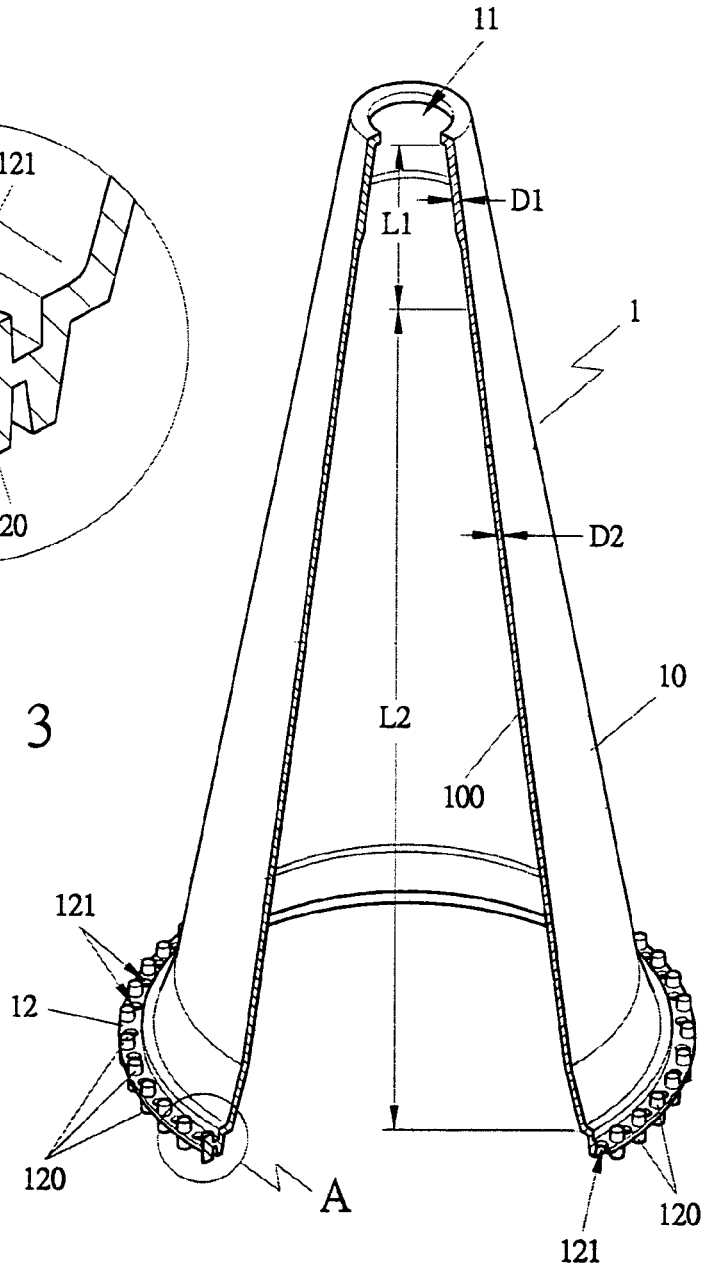
FIG. 2 is a cross-sectional and perspective view of the cone-shaped body of the first embodiment of a traffic cone in the present invention.
Figure 5:
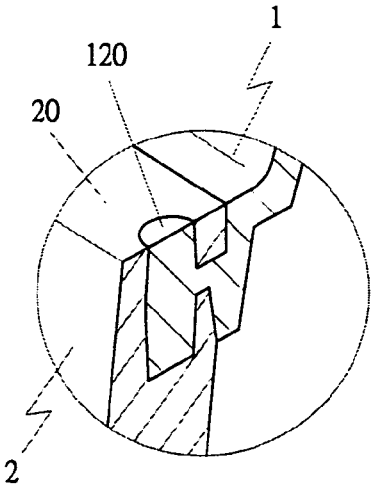
FIG. 5 is a magnified perspective view of a part marked B in FIG. 5.
Figure 6:
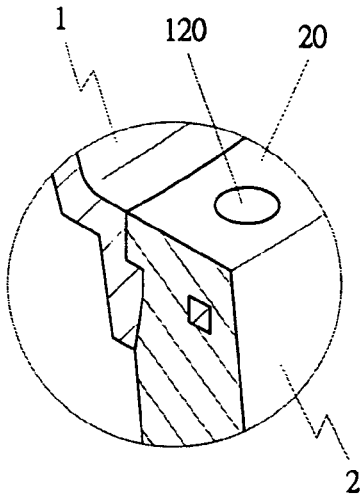
FIG. 6 is a magnified perspective view of a part marked C in FIG. 5.
Figure 4:
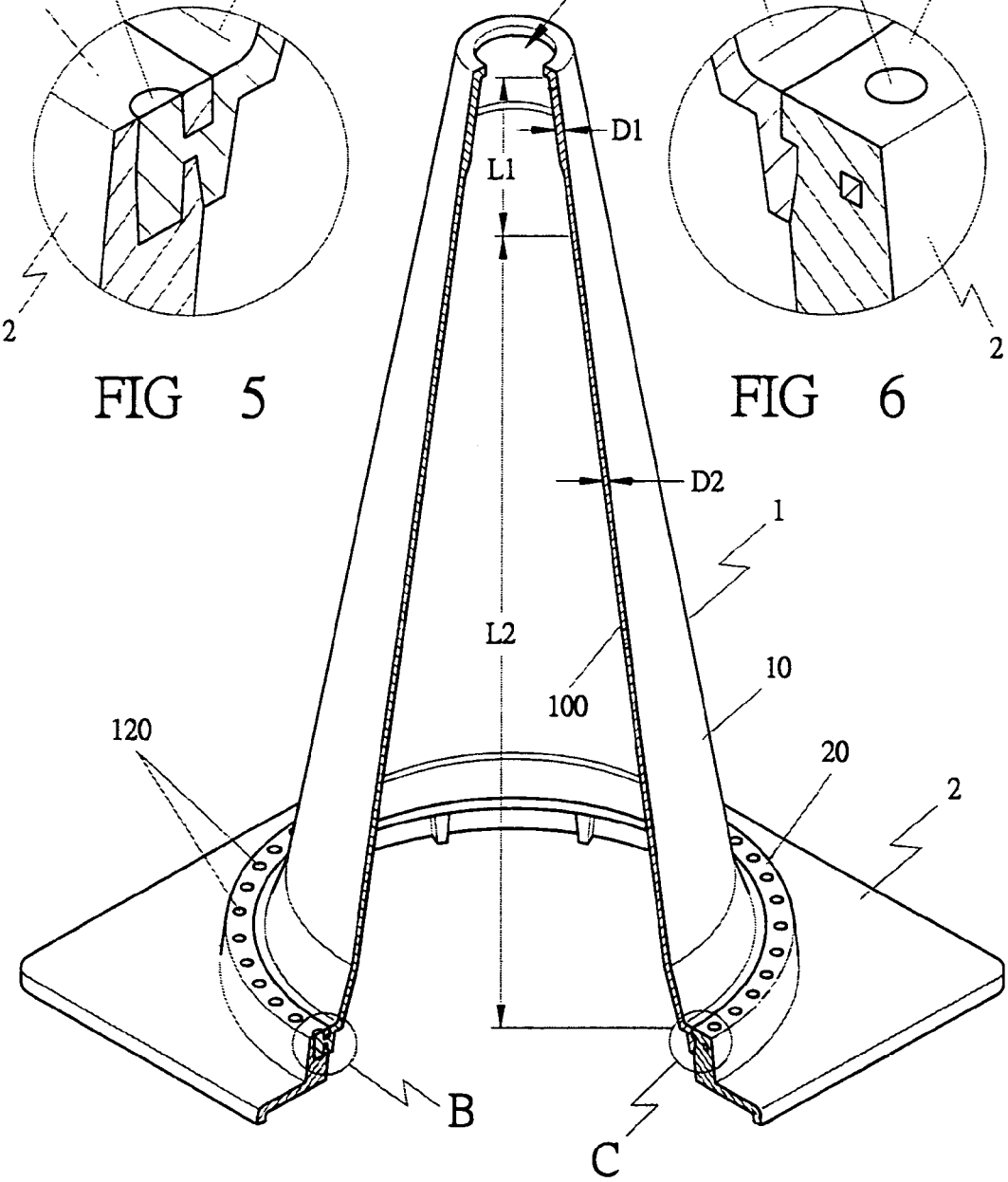
FIG. 4 is a cross-sectional and perspective view of the traffic cone of the first embodiment in the present invention.
Figure 7:
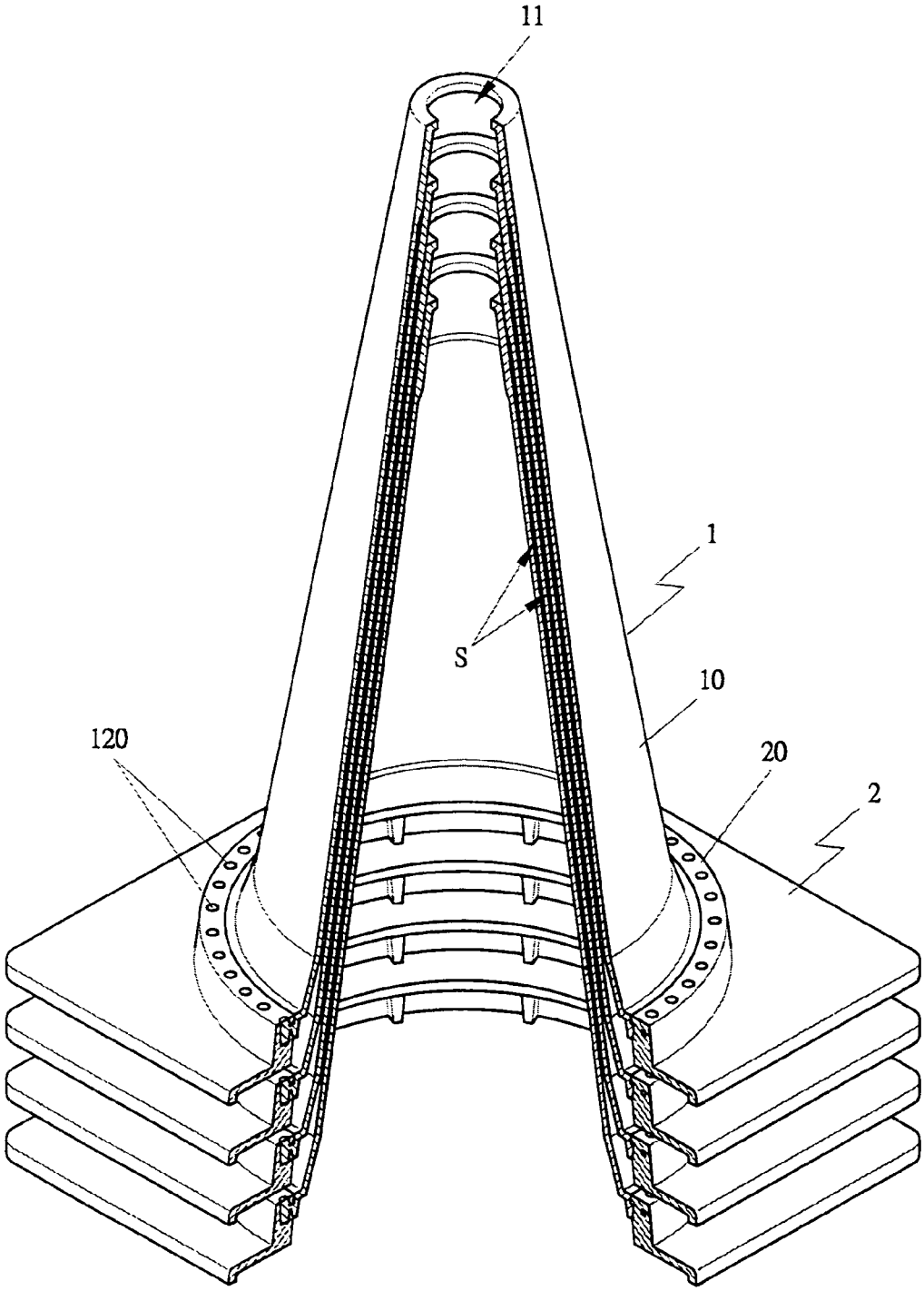
FIG. 7 is a cross-sectional and perspective view of a number of the traffic cones stacked in the present invention.
Figure 8:
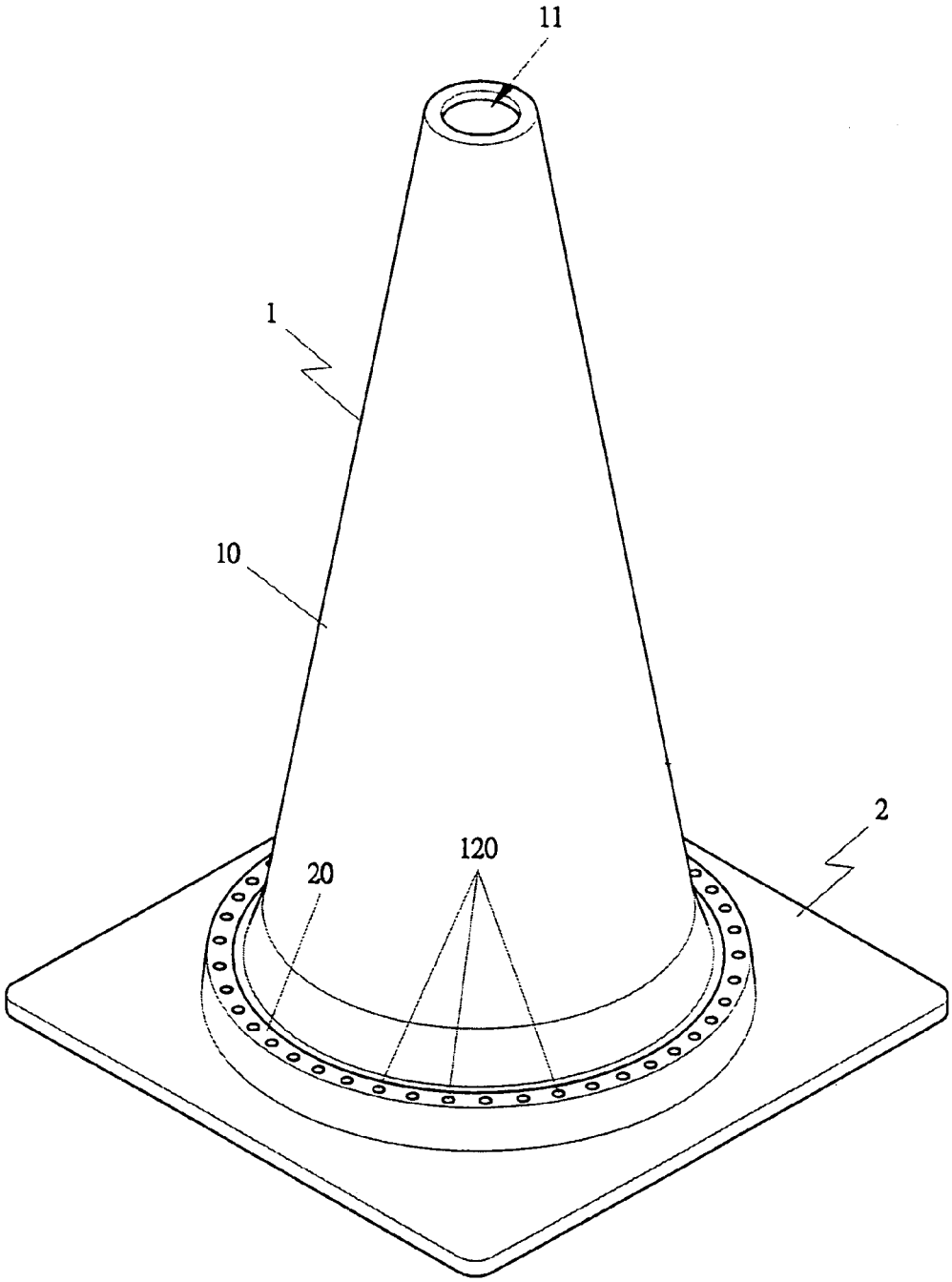
FIG. 8 is a perspective view of the traffic cone of the first embodiment in the present invention.

The cone-shaped body 1 has a tapered-up outer surface 10, a hole 11 formed in the top for inserting a warning flag, a warning light or the like, an L1 portion of the wall 100 having a thickness D1 larger than that D2 of an L2 portion of the wall 100 as shown in FIG. 2, and a connecting circumference 12 formed in a lower end and provided with many upright bars 120 extending up and down the connecting circumference 12 and spaced apart equidistantly with a through hole 121 formed between every two neighboring bars 120 as shown in FIG. 3.

The objective of the provision of the different thickness for the L1 and the L2 portion of the wall 100 is for convenience of stacking a number of the traffic cones, because the L1 portion of an upper traffic cone can have a gap (S) between its inner surface and an outer surface of a lower traffic cone after a number of the traffic cones are stacked. Then this gap (S) can facilitate every two neighboring traffic cones to separate from each other after stacked.

The base 2 is in a mold that an already formed cone-shaped body is placed in advance in, wrapping around completely the connecting circumference 12 of the cone-shaped body 1 to become integral with the cone-shaped body 1 hiding completely the circumference 12 and filling up the through holes 121, as shown in FIGS. 5 to 8. Further, a connecting surface 20 of base 2 hiding the connecting circumference 12 has a different color from that of the cone-shaped body 1.

Thus the traffic cone according to the invention has the base with a large weight to let its gravity center located in the base, so the traffic cone may not so easily fall down even in case of strong wind. In addition, the cone-shaped body 1 and the base have different colors from each other, with the base 2 with the deep or dark color not liable to look dirty. Apart from that, the base 2 can be made of recycled plastic to save its cost for the benefit of buyers. Asides that, the base of the traffic cone can be separated from the cone-shaped body by the force of a vehicle in case the vehicle should run over the traffic cone, not to get stuck with the chassis of the vehicle to keep safety of traffic.

Figure 9:
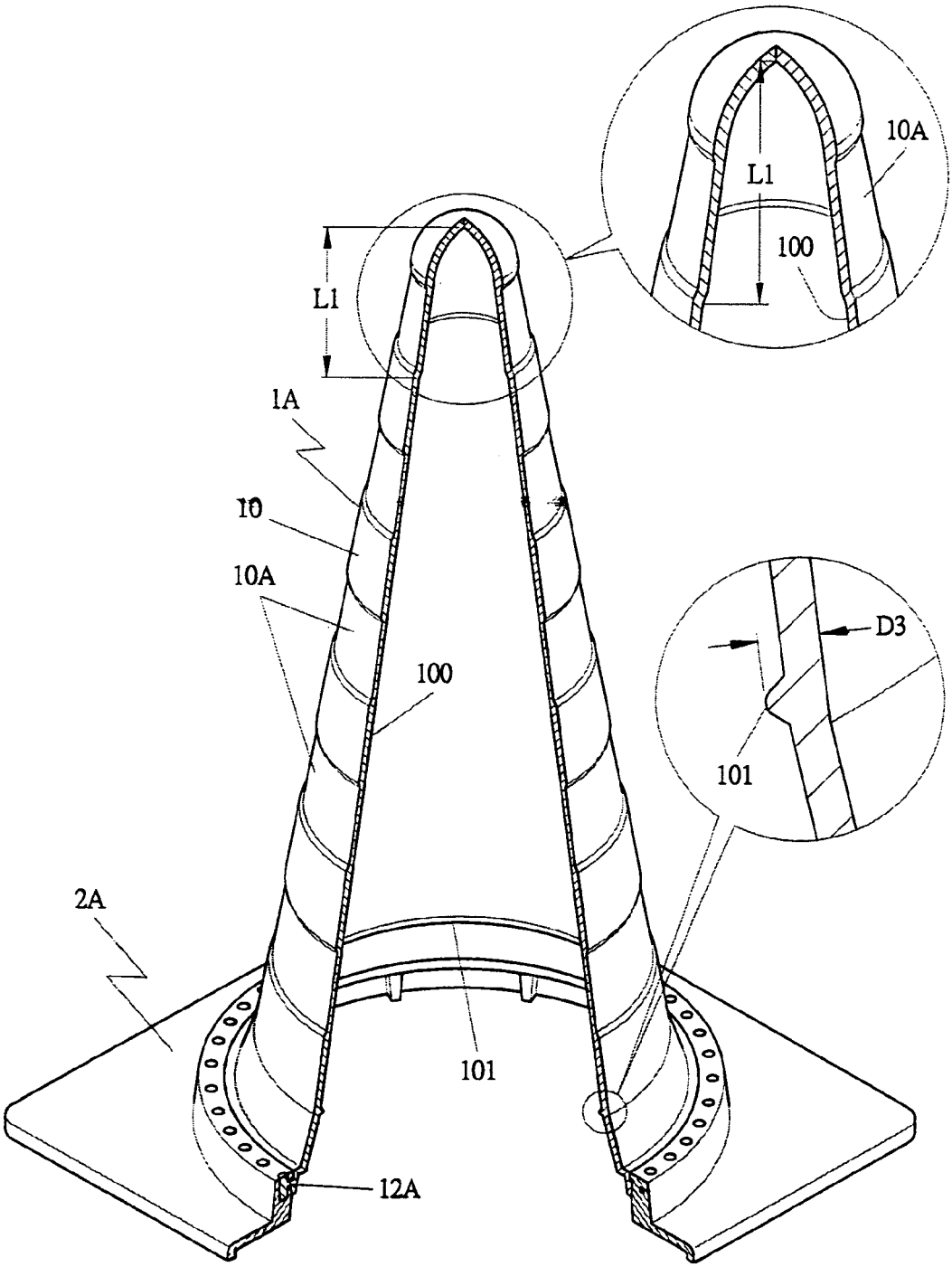
FIG. 9 is a cross-sectional and perspective view and a partial magnified view of a second embodiment of a traffic cone in the present invention.
Figure 10:
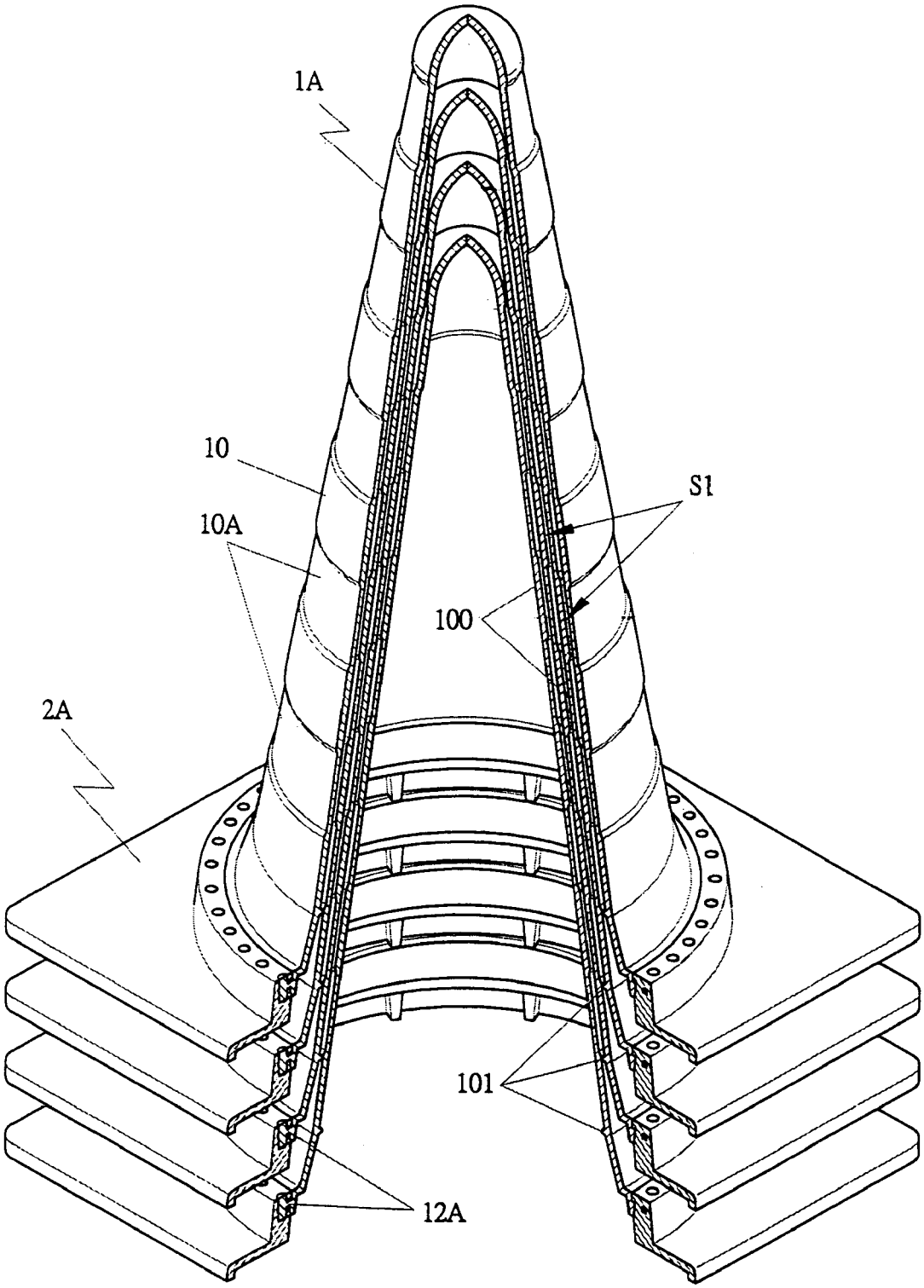
FIG. 10 is a cross-sectional and perspective view of a number of the second embodiment of a traffic cone stacked in the present invention.

FIGS. 9 and 10 show a second embodiment of a traffic cone in the present invention, which has a minor disparity from the first embodiment. The cone-shaped body 1A in the second embodiment is provided with plural continual annular recesses 10A on its outer surface, and a reflective paper can be adhered on the annular recesses 10A, located a little lower than the tapered outer surface 10 so the reflective paper may not rub with the ground even the traffic cone should fall down, prevented from getting wear and tear and able to keep the original effect of light reflection. In addition, the inner surface 100 of the cone-shaped body 1A is provided with an annular ridge 101 with a large thickness D3 in a lower portion, so every two neighboring traffic cones stacked may have a gap S1 as shown in FIG. 10 between them to permit them easily separated from each other. Then a large number of the traffic cones can save big space in storing by stacking one by one to a very large height.

The cone-shaped body 1A has the same connecting circumference 12A as that 12 in the first embodiment.

The base 2A is formed in a mold that an already formed cone-shaped body 1A is placed in advance, as in the same way of the first embodiment, also wrapping around the connecting circumference 12A to combine the cone-shaped body 1A integral with the base 2A as shown in FIG. 9. Thus the second embodiment has the same function and effect as the first embodiment, with its gravity center located in the base 2A.

Figure 12:
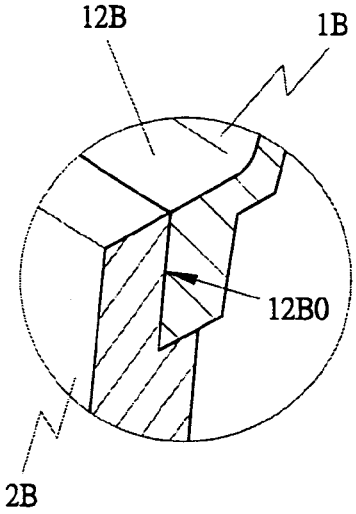
Figure 11:
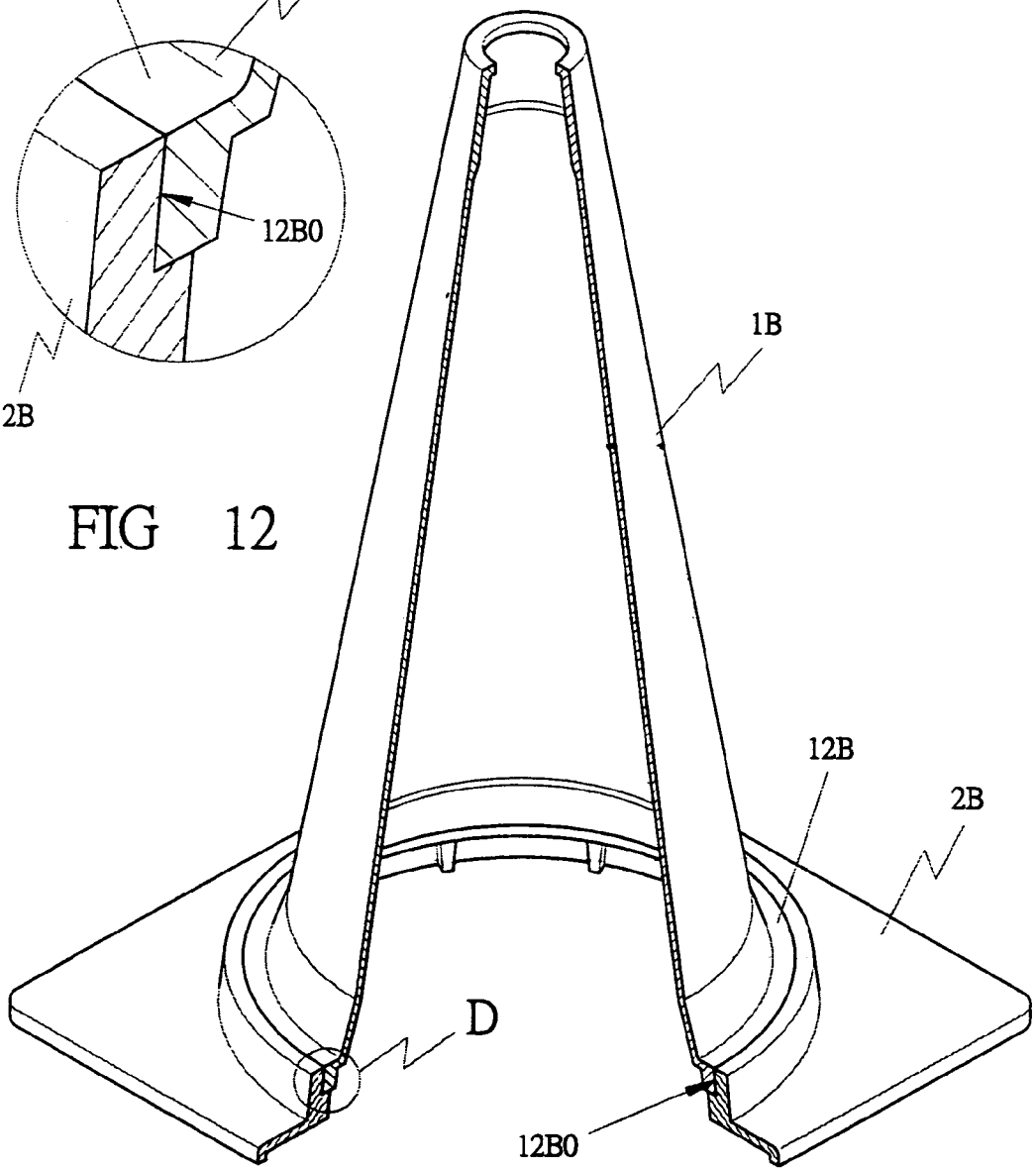
FIG. 11 is a cross-sectional and perspective view of the second embodiment of a traffic cone in the present invention; and, FIG. 12 is a magnified cross-sectional view of a part marked (D) in FIG. 11.

Next, FIGS. 11 and 12 show a third embodiment of a traffic cone in the present invention, which has almost the same structure, except a minor difference. The cone-shaped body 1B has a connecting circumference 12B with an annular wall 12B0 extending down in the lower end. The base 2B is formed in a mold that an already formed cone-shaped body 1B is placed in advance, with the annular wall 12B0 of the connecting circumference 12B fused by heat with the base 2B to form the cone-shaped body 1B combined integral with the base 2B as shown in FIGS. 11 and 12. Then the third embodiment has the same function and effect as that of the first embodiment, not easily falling down with the gravity center located in the base 2B.

While the preferred embodiments of the invention are described above, it will be recognized and understood that various modifications may be made therein and the appended claims are intended to cover all such modifications that may fall within the spirit and scope of the invention.

What is claimed is:

1. A traffic cone comprising:

a cone-shaped body provided with a connecting circumference formed in a lower end, said connecting circumference provided with a large number of upright bars spaced apart equidistantly, and a through hole formed between every two neighboring bars; and, a base combined with said cone-shaped body and provided with a center hole and an annular wall around said center hole wrapping and hiding said connecting circumference of said cone-shaped body and filling up said through holes of said connecting circumference.

2. The traffic cone as claimed in claim 1, wherein said cone-shaped body has an annular ridge on an inner surface of a lower portion, and said annular ridge has a thickness (D3).

* * * * *